United States Patent [19]

Kunii

[11] 4,128,085

[45] Dec. 5, 1978

[54] ENGINE MECHANICAL LOSS REDUCING SYSTEM

[75] Inventor: Kazuya Kunii, Yokohama, Japan

[73] Assignee: Nissan Motor Company, Limited, Japan

[21] Appl. No.: 797,139

[22] Filed: May 16, 1977

[30] Foreign Application Priority Data

May 17, 1976 [JP] Japan ..... 51/56217

[51] Int. Cl.[2] ..... F02B 75/06; F04L 1/18

[52] U.S. Cl. ..... 123/75 E; 123/75 B; 123/90.46; 123/105

[58] Field of Search ..... 123/75 B, 75 E, 70.15, 123/90.32, 90.46, 90.47, 90.57, 105, 109, 112, 119 DB, 124 R

[56] References Cited

U.S. PATENT DOCUMENTS

| | | | |
|---|---|---|---|
| 1,307,185 | 6/1919 | Clandel | 123/75 E |
| 1,998,494 | 4/1935 | Doering | 123/12 X |
| 2,036,936 | 4/1936 | Halford | 123/90.46 |
| 2,833,257 | 5/1958 | Lengnich | 123/90.57 |
| 3,416,502 | 12/1968 | Weiss | 127/75 E |
| 3,906,909 | 9/1975 | Garcea | 123/97 B |
| 3,919,986 | 11/1975 | Goto | 123/75 E |
| 3,986,351 | 10/1976 | Woods et al. | 123/75 E |
| 4,033,304 | 7/1977 | Luria | 123/75 E |

FOREIGN PATENT DOCUMENTS

| | | |
|---|---|---|
| 1001049 | 1/1957 | Fed. Rep. of Germany. |
| 1958627 | 6/1971 | Fed. Rep. of Germany. |
| 2544766 | 4/1977 | Fed. Rep. of Germany. |
| 367350 | 3/1963 | Switzerland. |

*Primary Examiner*—Charles J. Myhre
*Assistant Examiner*—David D. Reynolds

[57] ABSTRACT

An auxiliary intake passageway and an auxiliary intake valve operated for allowing an excessive air-fuel mixture to be drawn into a combustion chamber of an engine through the auxiliary intake passageway and for expelling the drawn excessive air-fuel mixture from the combustion chamber during low load operations of the engine and a bypass intake passageway and an auxiliary valve or a throttle valve operating device for increasing the flow of air passing through the intake passageway of the engine during the engine low load operations for ensuring the excessive air-fuel mixture drawn into the combustion chamber.

6 Claims, 4 Drawing Figures

ENGINE MECHANICAL LOSS REDUCING SYSTEM

BACKGROUND OF THE INVENTION

1. Field of the Invention

The present invention relates generally to a system for reducing mechanical loss of an internal combustion engine and particularly to a system for reducing pumping loss of an internal combustion engine by operating the engine during low load operating period thereof similarly to high load operations of an internal combustion engine having a stroke volume smaller than that of the former engine.

2. Description of the Prior Art

As is well known in the art, Otto cycle engines are incapable of transforming all of heat energy produced in combustion chambers thereof to shaft output and a fair portion of the heat energy is lost as various kinds of losses to cause decreases in thermal and mechanical efficiencies and to preclude an endeavor to make improvement in fuel economy.

As one of mechanical losses of the engine, there is pumping loss which takes place in the intake and exhaust strokes of the engine. A usual pumping loss is represented by the area surrounded by the line O-a-1-4-O in a Pressure-Volume diagram shown in FIG. 1 of the accompanying drawings. The pumping loss is greater during engine low load operating period rather than during engine high load operating period. For this reason, an automobile engine more used at low and medium loads is inferior in fuel consumption than an automobile engine more used at high loads.

Generally, when an engine equipped in an automobile is replaced by an engine having a stroke volume or capacity smaller than that of the former engine, the fuel consumption is reduced. It is one great reason for this that pumping loss is reduced due to the latter engine being operated at loads higher than those at which the former engine is operated.

Accordingly, if pumping loss is reduced by operating an engine during low load operating period thereof similarly to high load operations of an engine having a stroke volume smaller than that of the former engine without sacrificing characteristics required for high load operations thereof, fuel consumption will be able to be greatly improved or reduced.

This purpose is accomplished by reducing both restricting loss (increases in the suction vacuum) caused by making the degree of opening of a throttle valve of the engine small at the intake stroke and compressing loss caused at the compression stroke during the engine low load operating period. It is necessary for reducing the restricting loss to induct an excessive air-fuel mixture into a combustion chamber of the engine at the intake stroke, while it is necessary for reducing the compressing loss to expel the inducted excessive air-fuel mixture from the combustion chamber at the compression stroke to essentially reduce the swept capacity of the engine. As a solution to this problem, it is considered to greatly delay timing of closing of the intake valve during the engine low load operating period. However, this solution is lacking in the possibility of putting into practice, since it is difficult in mechanism to switch over timing of closing of the intake valve to a predetermined normal value during high load operating period of the engine.

SUMMARY OF THE INVENTION

It is, therefore, an object of the invention to provide a mechanical loss reducing system for operating an engine during low load operations thereof similarly to high load operations of an engine having a swept volume smaller than that of the former engine by inducting an excessive air-fuel mixture at the intake stroke and by expelling the inducted excessive air-fuel mixture at the compression stroke during engine low load operating period without employing the intake valve of the former engine.

This object is accomplished by providing the mechanical loss reducing system with an auxiliary intake passageway and an auxiliary intake valve opened concurrently with a main intake valve of the engine and closed later than the main intake valve during engine low load operating period for allowing an excessive air-fuel mixture to be drawn into a combustion chamber of the engine through the auxiliary intake passage at the intake stroke and for forcing out the drawn excessive air-fuel mixture from the combustion chamber at the compression stroke and with a combination of a bypass intake passageway and an auxiliary valve or a throttle valve operating device for increasing the flow of air passing through the intake passageway of the engine during the engine low load operations for ensuring the excessive air-fuel mixture drawn into the combustion chamber through the auxiliary intake valve.

BRIEF DESCRIPTION OF THE DRAWINGS

This and other features and advantages of the invention will become more apparent from the following detailed description taken in connection with the accompanying drawings in which.

DESCRIPTION OF THE SPECIFIC EMBODIMENT

Figure 2:
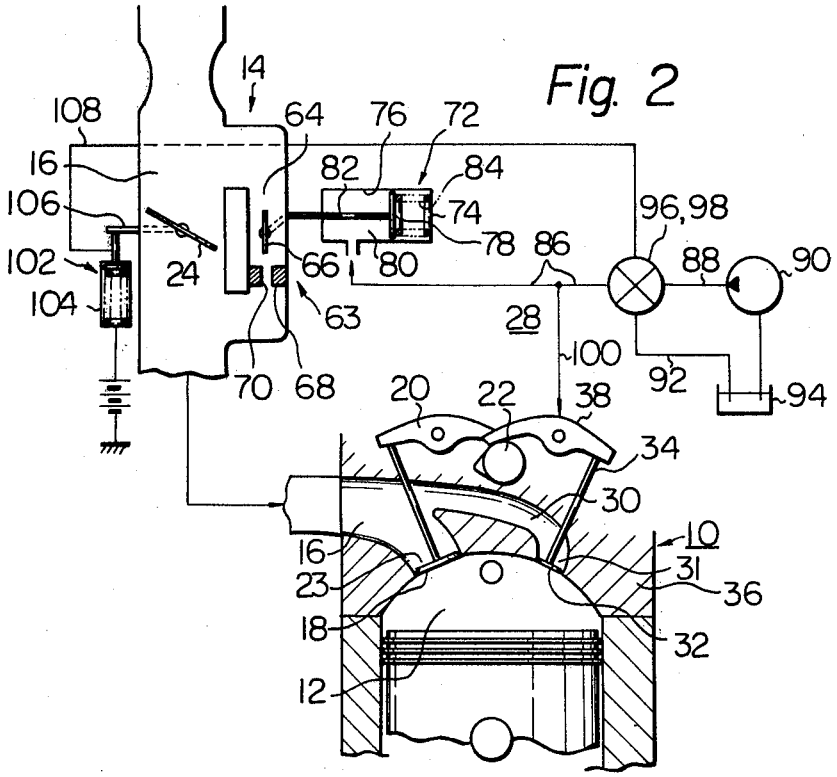
FIG. 2 is a schematic view of a preferred embodiment of an engine mechanical loss reducing system according to the invention.
Figure 3:
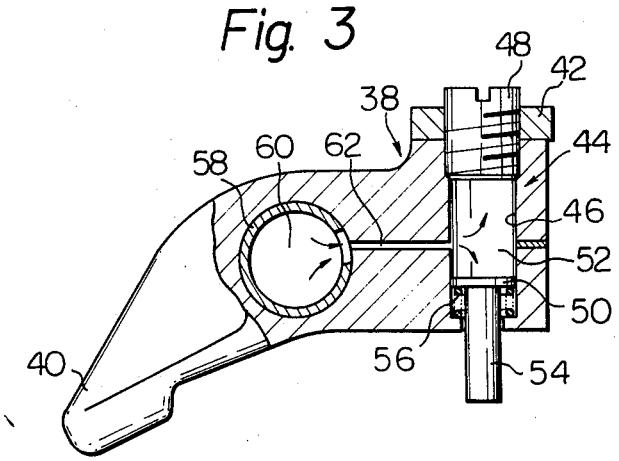
FIG. 3 is a schematic view of a hydraulic tappet forming part of the engine mechanical loss reducing system shown in FIG. 2.

Referring to FIGS. 2 and 3 of the drawings, there is shown a mechanical loss reducing system of an internal combustion engine. The engine, generally designated by the reference numeral 10, includes a combustion chamber 12, a carburetor 14, a main intake passageway 16, a main intake valve 18, a rocker arm 20 and a cam 22. The main intake passageway 16 passes through the carburetor 14 and provides communication between the atmosphere and the combustion chamber 12 through an intake port 23 and has a throttle valve 25 rotatably mounted therein. The main intake valve 18 is operated for opening and closing the intake port 23. The rocker arm 20 is pivotably mounted for swinging movement thereof around a fulcrum and is operatively connected at one end to the main intake valve 18 for operating same by the swinging movement of the rocker arm 20.

The cam 22 is in contact with the other end of the rocker arm 20 and is rotatably mounted for causing the swinging movement of the rocker arm 20. The engine 10 also includes an exhaust gas passageway and an exhaust gas valve (both not shown).

The mechanical loss reducing system, generally designated by the reference numeral 28, comprises an auxiliary intake passageway 30 branching off from the main intake passageway 16 and opening into the combustion chamber 12 through an auxiliary intake port 31. An auxiliary intake valve 32 is operably disposed for opening and closing the auxiliary intake passageway 30 during low load operating period of the engine 10. The auxiliary intake valve 32 is opened in synchronism with or concurrently with the main intake valve 18 for allowing an excessive air-fuel mixture to be drawn into the combustion chamber 12 and is closed much time later than timing of closing of the main intake valve 18 for expelling the drawn excessive air-fuel mixture from the combustion chamber 12. The auxiliary intake valve 32 is closed, for example, near the middle of the compression stroke or throw or when a crankshaft (not shown) of the engine 10 is rotated about 90° from bottom dead center in the compression stroke. The auxiliary intake valve 32 is urged by suitable biasing means (not shown) into a position in which it closes the auxiliary intake passageway 30. A valve stem 34 extends from the auxiliary intake valve 32 externally of a cylinder head 36. A rocker arm 38 is pivotably mounted for swinging movement thereof around a fulcrum and the cam 22 is in contact with one end 40 of the rocker arm 38 for causing the swinging movement thereof. The rocker arm 38 is connected and disconnected at the other end 42 to and from the valve stem 34 for causing opening and closing of the auxiliary intake valve 32 by the swinging movement of the rocker arm 38 only during the engine low load operating period.

The rocker arm 38 has at the other end 42 a portion 44 which forms a hydraulic tappet for providing connection and disconnection of the rocker arm 38 with and from the auxiliary intake valve 32 in accordance with load conditions of the engine 10. As shown in FIG. 3, the portion 44 is formed therein with a bore 46 which is closed at one end by an end plug 48. A piston 50 is slidably fitted in the bore 46 and a fluid chamber 52 is defined in the bore 46 between the end plug 48 and the piston 50. A pressurized hydraulic fluid is fed into the fluid chamber 52 and is exhausted from the fluid chamber 52 in accordance with load conditions of the engine 10, as will be described below. An operating rod 54 extends from the piston 50 toward the valve stem 34 of the auxiliary intake valve 32. A spring 56 is provided to urge the piston 50 toward the end plug 48. When a hydraulic fluid pressure is fed into the fluid chamber 52, the piston 50 is forced toward the valve stem 34 by the fluid pressure in opposition to the force of the spring 56 so that the operating rod 54 is engaged with or pressed against an end (not shown) of the valve stem 34 for providing connection of the rocker arm 38 with the auxiliary intake valve 32 and for transmitting the swinging movement of the rocker arm 38 to the auxiliary intake valve 32 for operating same. When the fluid pressure is exhausted from the fluid chamber 52, the piston 50 is moved away from the valve stem 34 by the force of the spring 56 so that the operating rod 54 is disengaged from the end of the valve stem 34 for providing disconnection of the rocker arm 38 from the auxiliary intake valve 32 and for holding the auxiliary intake valve 32 in the position shown in FIG. 2 in which the intake valve 32 closes the auxiliary intake passageway 30. For the engagement and disengagement of the operating rod 54 with and from the end of the valve stem 34, the valve stem 34 has, for example, a sleeve or collar (not shown) which is fixedly secured to the end of the valve stem 34 to extend therefrom toward the piston rod 54 and receives therein the piston rod 54 slidably. The rocker arm 38 is pivotably supported at the fulcrum by a hollow shaft 58 which is formed therein with an axial bore 60. The bore 60 communicates with the fluid chamber 52 through a passage 62 and is communicable with a pressurized hydraulic fluid source and a sump, as will be described below.

Returning to FIG. 2, flow rate or flow path increasing means 62 is provided for increasing the effective cross sectional area of the intake passageway 16 and therefore the flow of air passing therethrough for assuring an excessive air-fuel mixture drawn into the combustion chamber 12 through the auxiliary intake passageway 30 and the auxiliary intake valve 32 during the engine low load operating period. The flow increasing means 63 comprises a bypass intake passageway 64 formed in the carburetor 14 to provide communication between upstream and downstream parts of the intake passageway 16 to bypass the throttle valve 24. An auxiliary valve 66 is rotatably mounted in the bypass intake passageway 64 for opening same during the engine low load operating period only. The bypass intake passageway 64 is provided therein with a restriction 68 which has formed therethrough an orifice 70. The restriction 68 controls the flow of air passing through the bypass intake passageway 64. As an expedient for causing the auxiliary valve 66 to open and close the bypass intake passageway 64, for example, a hydraulic motor 72 is provided which comprises a housing 74 such as a cylinder which is formed therein with a bore 76. A piston 78 is slidably fitted in the bore 76 to define a fluid chamber 80 therein. A piston rod 82 extends from the piston 78 externally of the housing 74 and is operatively connected to the auxiliary valve 66. A spring 84 is provided to urge the piston 78 into a first position in which the auxiliary valve 66 closes the bypass intake passageway 64. A pressurized hydraulic fluid is fed into the fluid chamber 80 and is exhausted from the fluid chamber 80 in accordance with the load conditions of the engine 10. When the pressurized hydraulic fluid is present in the fluid chamber 80, the piston 78 is moved by the fluid pressure in opposition to the force of the spring 84 into a second position shown in FIG. 2 in which the auxiliary valve 66 fully opens the auxiliary intake passageway 64. When the pressurized hydraulic fluid is absent in the fluid chamber 80, the piston 78 is returned into the first position by the force of the spring 84.

The fluid chamber 80 is communicable through passages 86 and 88 with a pressurized hydraulic fluid source 90 for receiving a pressurized hydraulic fluid therefrom and through the passage 86 and a passage 92 with a hydraulic fluid sump 94 for exhausting the pressurized hydraulic fluid thereinto. The source 90 may be, for example, a hydraulic fluid pump, an engine oil gallery or the like. A switching-over valve 96 is provided for alternatively communicating the passage 86 and therefore the fluid chamber 80 with the passages 88 and 92 and therefore the source 90 and the sump 94 in accordance with the load conditions of the engine 10. The switching-over valve 96 assumes a first position to communicate the passage 86 with the passage 88 and to separate the passage 86 from the passage 92 when the engine 10 is running at a load below a predetermined value and a second position to separate the passage 86 from the passage 88 and to communicate the passage 86 with the passage 92 when the engine 10 is running at a load above the predetermined value. The switching-over valve 96 is electromagnetically operated between the first and second positions by operating means 98 in this embodiment. The operating means 98 may include a solenoid and a spring (both not shown).

The bore 60 of the hollow shaft 58 communicates with the passage 86 through a passage 100 for receiving the pressurized hydraulic fluid from the source 90 when the switching-over valve 96 assumes the first position and for exhausting the pressurized hydraulic fluid into the sump 94 when the switching-over valve 96 assumes the second position.

Control means 102 is provided for causing the operating means 98 to alternatively move the switching-over valve 96 into the first and second positions in accordance with the load conditions of the engine 10. The control means 102 comprises, for example, a throttle valve switch 104 which is controlled by a lever 106 which is operated integrally with the throttle valve 24. The switch 104 is electrically connected to the operating means 98 through a wiring 108 and is closed and opened when the degree of opening of the throttle valve 24 is below and above a predetermined value, respectively. The predetermined value may be, for example, a value corresponding to the opening degree of one fourth of the full opening degree of the throttle valve 24. When the switch 104 is closed and opened, the operating means 98 moves the switching-over valve 96 into the first and second positions, respectively.

The mechanical loss reducing system 26 thus described is operated as follows:

When the engine 10 is running at a partial load, for example, with the throttle valve 24 opened below one fourth of the maximum opening degree thereof, the throttle valve switch 104 is closed to cause the operating means 98 to move the switching-over valve 96 into the first position to provide communication between the source 90 and both the hydraulic tappet 44 and the hydraulic motor 72. As a result, on the one hand, the piston 50 of the hydraulic tappet 44 is forced toward the auxiliary intake valve 32 by a pressurized hydraulic fluid fed from the source 90 into the fluid chamber 52 and in opposition to the force of the spring 56 to push the operating rod 54 against the end of the valve stem 34 to provide connection between the rocker arm 38 and the auxiliary intake valve 32. Due to the provision of such a connection, the auxiliary intake valve 32 is undulated to open and close the auxiliary intake passageway 30 by the rocker arm 38 which is swingingly moved around the axis of the hollow shaft 58 in obedience to the rotation of the cam 22. Each opening and closing of the auxiliary intake valve 32, the intake valve 32 is opened together with the intake valve 18 and is closed when the crankshaft has rotated about 90° from the bottom dead center after the beginning of the compression stroke. As a result, about half of an air-fuel mixture drawn through both the intake port 23 and the auxiliary intake port 31 into the combustion chamber 12 is forced back into the intake passageway 16 through the auxiliary intake port 31 during the compression stroke and the remaining half of the air-fuel mixture drawn is confined in the combustion chamber 12. As to this respect, as compared with an ordinary engine which is not provided with a mechanical loss reducing system, assuming that an air-fuel mixture of the quantity of Q is drawn into a combustion chamber of the ordinary enging to produce an output T when a throttle valve of the ordinary engine is opened a certain amount equal to the degree of opening of the throttle valve 24 of the engine 10, an air-fuel mixture of the quantity of $2 \times Q$ is drawn into the combustion chamber 12 through the main and auxiliary intake ports 23 and 31 during the intake stroke and the air-fuel mixture of the quantity of Q is returned back into the intake passageway 16 through the auxiliary intake port 31 during the compression stroke so that the air-fuel mixture of the quantity of Q remains in the combustion chamber 12 and an output T is produced. In this instance, since the stroke volume of the engine 10 materially becomes about one half of that in the case in which the auxiliary intake valve 32 is inoperative or held closed, the operation of the engine 10 at this time is relatively equivalent to a high load operation of an engine having a smaller stroke volume.

On the other hand, the piston 78 of the hydraulic motor 72 is moved by a pressurized hydraulic fluid fed from the source 90 into the fluid chamber 80 and in opposition to the force of the spring 84 so that the auxiliary valve 66 is moved into a position to fully open the bypass intake passageway 64 and it is rendered possible for the air-fuel mixture of the quantity of $2 \times Q$ to be drawn from the carburetor 14 into the combustion chamber 12. The flow of air passing through the bypass intake passageway 64 compensates the quantity of an air-fuel mixture drawn into the combustion chamber 12 which is reduced below the value $2 \times Q$ due to the vacuum in the intake passageway 16 downstream of the throttle valve 24, that is, the suction vacuum which is reduced by the presence of the air-fuel mixture returned back into the intake passageway 16 through the auxiliary intake port 31.

Figure 1:
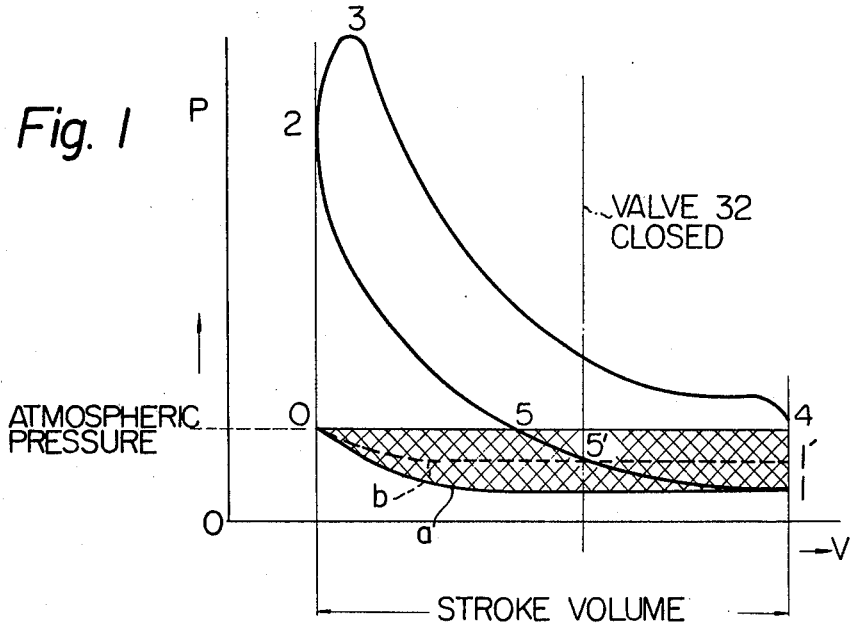
FIG. 1 is a Pressure-Volume (P-V) diagram of the relationship between the pressure and the volume of a working gas in a combustion chamber of an Otto cycle engine.

As the result of an excessively increased quantity of air-fuel mixture being fed into the combustion chamber 12 in low load operating conditions of the engine 10, restricting loss at the intake stroke is reduced to thereby reduce pumping loss from the value corresponding to the area surrounded by the line O-a-1-4-O to the value corresponding to the area surrounded by the line O-b-1'-4-O as shown in FIG. 1. In this instance, the relationship between the pressure and the volume at the compression stroke is varied from the curve 1-5-'-5-2 to the curve 1'-5'-5-2 as shown in FIG. 1.

When the engine 10 is running at a relatively high load above a predetermined value corresponding to the opening degree of, for example, one fourth of the maximum throttle opening degree, the throttle valve switch 104 is opened to cause the operating means 98 to move the switching-over valve 96 into the second position to provide communication between the sump 94 and both the hydraulic tappet 44 and the hydraulic motor 72. As a result, on the one hand, since the pressurized hydraulic fluid becomes absent in the fluid chamber 52 of the hydraulic tappet 44, the piston 50 is moved away from the valve stem 34 by the force of the spring 56 to disengage the operating rod 54 from the end of the valve stem 34. Accordingly, the auxiliary intake valve 32 is disconnected from the rocking arm 38 to be held in a position to close the auxiliary intake port 31. On the other hand, since the pressurized hydraulic fluid becomes absent in the fluid chamber 80 of the hydraulic motor 72, the piston 78 is moved by the force of the spring 84 into a position in which the bypass intake passageway 64 is fully closed by the auxiliary valve 66. As a result, the engine 10 operates to produce a predetermined high output similarly to an ordinary engine provided with no mechanical loss reducing system during the relatively high load operating period of the engine 10.

Figure 4:
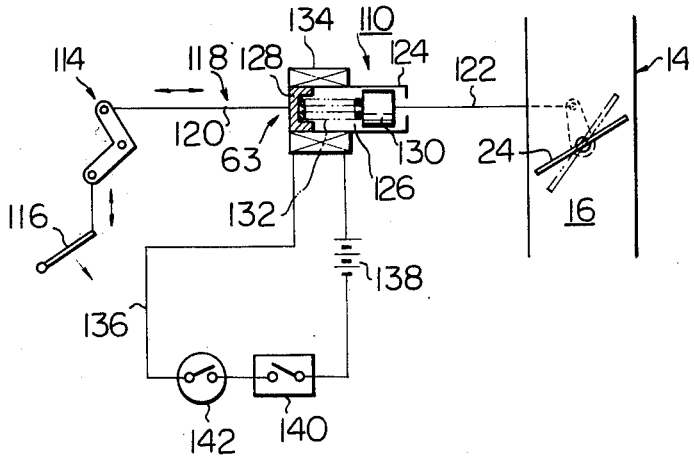
FIG. 4 is a schematic view of an other example of flow increasing means forming part of an engine mechanical loss reducing system according to the invention.

Referring to FIG. 4 of the drawings, there is shown an other example of flow rate or flow path increasing means 63. Flow rate increasing means 63 shown in FIG. 4 comprises a throttle valve operating device 110 for automatically increasing the degree of opening of the throttle valve 24 during the engine low load operating period. The throttle valve operating device 110 is combined with a linkage mechanism 114 operatively connecting an accelerator pedal 116 of the engine 10 to the throttle valve 24 and including a driving like 118 and is located in the driving link 118 to divide some into first and second links 120 and 122 which are connected respectively to the accelerator pedal 116 and a shaft of the throttle valve 24. The throttle valve operating device 110 comprises a support frame or casing 124 having a bore or chamber 126 therein and allowing a magnetic attracting force to penetrate the chamber 126. A stationary core 128 is located at one end of the frame 124 stationarily with respect to same and is connected to the link 120. The position of the stationary core 128 is adjustable. A movable core 130 is slidably located in the chamber 126 and is connected to the link 122. The movable core 130 is made of a magnetic material such as iron to be moved in response to a magnetic force and has a first position in which it is engaged with the stationary core 128 to shorten the length of the driving link 118 and to open the throttle valve 24 a suitable amount and a second position in which it is disengaged from the stationary core 128 to lengthen the length of the driving link 118 and to cause the throttle valve 24 to return to a former position. The movable core 130 is moved into the first position by a magnetic force produced in the chamber 126. A spring 132 is provided to urge the movable core 130 into the second position. A solenoid core 134 is wound around the frame 124 and the stationary core 128 and is energized and deenergized in accordance with the load conditions of the engine 10 to produce and fail to produce a magnetic force in the chamber 126, respectively. The stationary core 128 is made of a material such as iron which is magnetized by energization of the solenoid coil 134 to produce a magnetic force attracting the movable core 130. The solenoid coil 134 forms part of an electric control circuit 136 which includes an electric power source 138, a load sensing switch 140 and an ignition switch 142 connected in series to each other. The switch 140 is provided for sensing the low load operating conditions of the engine 10 by sensing the pressure in the hydraulic fluid flow path 86, 100, 60, 62 and 52 between the switching-over valve 96 and the hydraulic tappet 44. The throttle valve 24 is turned in opposite directions to open and close the intake passageway 16 in response to movements of the accelerator pedal 116 in output increasing and reducing directions.

The flow rate increasing means 110 thus described is operated as follows:

When the auxiliary intake valve 32 is operated to open and close the auxiliary intake port 31 by the swinging movement of the rocker arm 38 during the engine low load operating period, the switch 140 is closed to energize the solenoid coil 134 in response to the hydraulic fluid pressure fed to the hydraulic tappet 44. By the magnetic force produced in response to energization of the solenoid coil 134, the movable core 130 is moved away from the throttle valve 24 in opposition to the force of the spring 132 and is engaged with the stationary core 128. By such a movement of the movable core 130, the length of the driving link 118 is shortened to move the throttle valve 24 from a position shown by the solid line in FIG. 4 into a position shown by the phantom line in FIG. 4 to increase the degree of opening of the throttle valve 24. As a result, a predetermined necessary quantity of air is ensured which is drawn into the combustion chamber 12 for reducing the restricting loss and therefore the pumping loss.

When the solenoid coil 134 is deenergized, since the movable core 130 is moved by the force of the spring 132 into the second position to cause the throttle valve 24 to return to a former position in which the throttle valve 24 is closed the suitable amount, in the event of a failure of the electric control circuit 136 the throttle valve 24 is similarly closed the suitable amount to avoid risks of overrun of the engine 10 and so on.

A switch may be used which senses the first and second positions of the switching-over valve 96, or signals which cause the switching-over valve 96 to move into the first and second positions in lieu of the switch 140 which senses the presence and absence of the pressurized hydraulic fluid fed to the hydraulic tappet 44.

As the control means 102, a switch may be employed which is closed and opened in response to the degrees of depression of the accelerator pedal 116 corresponding to low loads and loads of the engine 10 higher than the low loads, in lieu of the throttle valve switch 104.

It will be appreciated that the invention provides an engine mechanical loss reducing system which reduces pumping loss of an engine to greatly reduce fuel consumption of the engine during low load operating period thereof.

It will be also appreciated that when a portion of an air-fuel mixture drawn into a combustion chamber is forced out therefrom through an auxiliary intake valve in the compression stroke, since residual gas is concurrently forced out from the combustion chamber, the substitution of a fresh air-fuel mixture for residual gas is promoted to reduce the amount of residual gas in the combustion chamber and to increase the stability of operation of the engine during engine low load operating period.

What is claimed is:

1. A mechanical loss reducing system of an internal combustion engine including a combustion chamber, a main intake passageway providing communication between the atmosphere and the combustion chamber through an intake port, a main intake valve for opening and closing the intake port, and output control means for controlling the output of the engine, said mechanical loss reducing system comprising flow increasing means for increasing the flow of air passing through the main intake passageway during low load operations of the engine for feeding an excessive air-fuel mixture to the combustion chamber, an auxiliary intake passageway branching off from the main intake passageway and opening into the combustion chamber, an auxiliary intake valve for opening and closing said auxiliary intake passageway, operating means for causing said auxiliary intake valve to open said auxiliary intake passageway at the intake stroke during the engine low load operations for causing said excessive air-fuel mixture to be drawn into the combustion chamber and for causing said auxiliary intake valve to close said auxiliary intake passageway later than the main intake valve at the compression stroke during the engine low load operations for expelling said drawn excessive air-fuel mixture from the combustion chamber.

2. A mechanical loss reducing system as claimed in claim 1, in which said operating means comprising a rocker arm pivotably mounted for swinging movement thereof, said rocker arm being connected to and disconnected from said auxiliary intake valve in accordance with load conditions of the engine and causing said auxiliary intake valve to open and close said auxiliary intake passageway by said swinging movement when connected to said auxiliary intake valve, drive means for causing said swinging movement of said rocker arm, and a hydraulic tappet for connecting and disconnecting said rocker arm to and from said auxiliary intake valve in accordance with load conditions of the engine.

3. A mechanical loss reducing system as claimed in claim 2, in which said auxiliary intake valve comprises a valve stem extending therefrom toward said rocker arm, said hydraulic tappet comprises means defining a bore/and forming port of said rocker arm, a piston slidably fitted in said bore and having on a side thereof a fluid chamber alternatively communicating with a pressurized hydraulic fluid source and a hydraulic fluid sump for causing the presence and absense of a pressurized hydraulic fluid in said fluid chamber, respectively, an operating rod extending from said piston toward said valve stem and connected to and disconnected from said valve stem in response to the presence and absence of said pressurized hydraulic fluid in said fluid chamber, respectively, a switching-over valve for alternatively communicating said fluid chamber with said source and said sump, and sensing means for causing said switching-over valve to communicate said fluid chamber with said source in response to positions of said output control means which correspond to low loads of the engine and with said sump in response to positions of said output control means which correspond to loads of the engine higher than said low loads.

4. A mechanical loss reducing system as claimed in claim 1, in which said output control means comprises a throttle valve rotatably mounted in the main intake passageway, said flow increasing means comprising a bypass intake passageway bypassing the main intake passageway at a section having the throttle valve, an auxiliary valve for opening said bypass intake passageway, and control means for holding said auxiliary valve into a first position to close said bypass intake passageway in response to loads of the engine higher than low loads and for moving said auxiliary valve into a second position to open said bypass intake passageway in response to said low loads of the engine 10.

5. A mechanical loss reducing system as claimed in claim 4, in which the last-mentioned control means comprises a hydraulic motor comprising a casing formed therein with a bore, a piston slidably fitted in said bore and having at a side thereof in said bore a fluid chamber alternatively communicating with a pressurized hydraulic fluid source and a hydraulic fluid sump, said piston being operatively connected to said auxiliary valve for moving same into said first and second positions in response to communication of said fluid chamber with said sump and with said source, respectively, a switching-over valve for alternatively communicating said fluid chamber with said source and with said sump, and sensing means for causing said switching-over valve to communicate said fluid chamber with said source in response to positions of the output control means which correspond to low loads of the engine and with said sump in response to positions of the output control means which correspond to loads of the engine higher than said low loads.

6. A mechanical loss reducing system as claimed in claim 2, in which the output control means comprises a throttle valve rotatably mounted in the main intake passageway, an accelerator pedal, and a driving link interconnecting the throttle valve and the accelerator pedal, said flow increasing means comprising a throttle valve operating device which is located in the driving link and divides the driving link into first and second links connected respectively to the accelerator pedal and the throttle valve and comprises a support frame, a stationary core located stationarily with respect to said support frame and connected to the first link, a movable core slidably located in said support frame and connected to the second link and having a first position in which it is engaged against said stationary core to open the throttle valve a suitable amount and a second position in which it is disengaged from said stationary core to cause the throttle valve to return to a former position, a solenoid coil wound around said support frame and energized and deenergized for causing said movable core to move into said first and second positions, respectively, and sensing means for energizing said solenoid coil in response to connection of said rocker arm with said auxiliary intake valve and for deenergizing said solenoid coil in response to disconnection of said rocker arm from said auxiliary intake valve.

* * * * *